US011457660B2

(12) United States Patent
Watanabe

(10) Patent No.: US 11,457,660 B2
(45) Date of Patent: Oct. 4, 2022

(54) ELECTRONIC CIGARETTE CARTRIDGE USING TOBACCO PLANT OR NON-TOBACCO PLANT AND SUPPORT MEMBER THEREOF

(71) Applicant: Future Technology Co., Ltd., Kagoshima (JP)

(72) Inventor: Ryuji Watanabe, Tokyo (JP)

(73) Assignee: FUTURE TECHNOLOGY CO., LTD., Kagoshima (JP)

( * ) Notice: Subject to any disclaimer, the term of this patent is extended or adjusted under 35 U.S.C. 154(b) by 240 days.

(21) Appl. No.: 16/639,357

(22) PCT Filed: Aug. 2, 2017

(86) PCT No.: PCT/JP2017/028149
§ 371 (c)(1),
(2) Date: Feb. 14, 2020

(87) PCT Pub. No.: WO2018/230003
PCT Pub. Date: Dec. 20, 2018

(65) Prior Publication Data

US 2020/0245679 A1 Aug. 6, 2020

(30) Foreign Application Priority Data

Jun. 16, 2017 (JP) ..... 2017-002719 U

(51) Int. Cl.
*A24D 1/20* (2020.01)
*A24F 40/48* (2020.01)
(Continued)

(52) U.S. Cl.
CPC ..... *A24D 1/20* (2020.01); *A24B 15/167* (2016.11); *A24F 40/20* (2020.01); *A24F 40/42* (2020.01); *A24F 40/48* (2020.01)

(58) Field of Classification Search
CPC . A24D 1/20; A24F 40/20; A24F 40/42; A24F 40/48; A24B 15/167
(Continued)

(56) References Cited

U.S. PATENT DOCUMENTS 4,991,596 A 2/1991 Lawrence
5,060,671 A 10/1991 Counts
(Continued)

FOREIGN PATENT DOCUMENTS

CN 1700864 A 11/2005
CN 103763949 A 4/2014
(Continued)

OTHER PUBLICATIONS

Extended European Search Report issued in European Appln. No. 17913320.2 dated May 4, 2021.
(Continued)

*Primary Examiner* — Hae Moon Hyeon
(74) *Attorney, Agent, or Firm* — Rossi, Kimms & McDowell LLP

(57) ABSTRACT

A support member capable of stably supporting an aerosol-forming base material at the time of inserting a heating element while securing a flow passage through which an aerosol is transferred in an electronic cigarette cartridge is provided. A support member for an electronic cigarette cartridge using a tobacco plant or a non-tobacco plant is provided. The support member has a central portion located along the longitudinal center axis of the electronic cigarette cartridge, and a plurality of side portions which extends outward from the central portion and is in contact with a packaging member located at the periphery of the electronic cigarette cartridge. The support member is disposed adjacent to an aerosol-forming base material located in one end portion of the electronic cigarette cartridge, or is disposed
(Continued)

with other members sandwiched between the aerosol-forming base material and the support member and supports the aerosol-forming base material.

14 Claims, 6 Drawing Sheets

(51) Int. Cl.
*A24F 40/42* (2020.01)
*A24F 40/20* (2020.01)
*A24B 15/167* (2020.01)

(58) Field of Classification Search
USPC ..... 131/328, 329
See application file for complete search history.

(56) References Cited

U.S. PATENT DOCUMENTS

| | | | | |
|---|---|---|---|---|
| 10,517,328 | B2 | 12/2019 | Polloni | |
| 2006/0130862 | A1 | 6/2006 | Dittrich | |
| 2007/0023056 | A1 | 2/2007 | Cantrell | |
| 2011/0271971 | A1 | 11/2011 | Conner | |
| 2012/0255569 | A1 | 10/2012 | Beard | |
| 2013/0255702 | A1 | 10/2013 | Griffith, Jr. | |
| 2014/0123992 | A1* | 5/2014 | Thomas | A24D 1/22 131/349 |
| 2014/0137881 | A1* | 5/2014 | Branton | A24D 3/066 493/43 |
| 2014/0182614 | A1* | 7/2014 | Nicholls | A24D 3/061 131/352 |
| 2014/0202479 | A1* | 7/2014 | Nicholls | A24D 3/048 131/337 |
| 2014/0224268 | A1* | 8/2014 | Ryter | A24D 3/045 493/39 |
| 2014/0283857 | A1 | 9/2014 | Liu | |
| 2014/0305448 | A1* | 10/2014 | Zuber | A24D 1/20 131/328 |
| 2015/0027475 | A1 | 1/2015 | Jarriault | |
| 2015/0040929 | A1 | 2/2015 | Hon | |
| 2015/0136154 | A1* | 5/2015 | Mitrev | A24D 1/20 131/328 |
| 2015/0163859 | A1 | 6/2015 | Schneider | |
| 2016/0143362 | A1 | 5/2016 | Boldrini | |
| 2016/0143363 | A1 | 5/2016 | Boldrini | |
| 2016/0295917 | A1 | 10/2016 | Malgat | |
| 2016/0295926 | A1 | 10/2016 | Zuber | |
| 2016/0316816 | A1 | 11/2016 | Lavanchy | |
| 2016/0331032 | A1 | 11/2016 | Malgat | |
| 2017/0027234 | A1 | 2/2017 | Farine | |
| 2018/0098568 | A1 | 4/2018 | Qiu | |
| 2018/0116286 | A1 | 5/2018 | Polloni | |
| 2019/0037926 | A1 | 2/2019 | Qiu | |
| 2019/0110518 | A1 | 4/2019 | Foghei | |
| 2019/0246697 | A1 | 8/2019 | Madera | |
| 2021/0052832 | A1* | 2/2021 | Spadaro | A61M 15/003 |

FOREIGN PATENT DOCUMENTS

| | | | |
|---|---|---|---|
| CN | 104284605 | A | 1/2015 |
| CN | 104470387 | A | 3/2015 |
| CN | 204273238 | U | 4/2015 |
| CN | 105722415 | A | 6/2016 |
| CN | 105992524 | A | 10/2016 |
| CN | 106231934 | A | 12/2016 |
| CN | 205993635 | U | 3/2017 |
| EP | 3469933 | A1 | 4/2019 |
| EP | 3656227 | A1 | 5/2020 |
| JP | H03277265 | A | 12/1991 |
| JP | 2000041654 | A | 2/2000 |
| JP | 2009502194 | A | 1/2009 |
| JP | 3160951 | U | 7/2010 |
| JP | 2014526275 | A | 10/2014 |
| JP | 2015506713 | A | 3/2015 |
| JP | 2015508676 | A | 3/2015 |
| JP | 2015512262 | A | 4/2015 |
| JP | 2015530106 | A | 10/2015 |
| JP | 2016506729 | A | 3/2016 |
| JP | 2016512701 | A | 5/2016 |
| JP | 2016104007 | A | 6/2016 |
| JP | 2016104009 | A | 6/2016 |
| JP | 6000451 | B2 | 9/2016 |
| JP | 2016538848 | A | 12/2016 |
| JP | 2017500852 | A | 1/2017 |
| JP | 3212228 | U | 8/2017 |
| JP | 2018511336 | A | 4/2018 |
| JP | 2018511337 | A | 4/2018 |
| JP | 2019000094 | A | 1/2019 |
| JP | 2019000097 | A | 1/2019 |
| JP | 2019510483 | A | 4/2019 |
| JP | 2019513381 | A | 5/2019 |
| JP | 2019520795 | A | 7/2019 |
| JP | 2019524120 | A | 9/2019 |
| JP | 2019533456 | A | 11/2019 |
| JP | 2019534808 | A | 12/2019 |
| RU | 2581999 | C2 | 4/2016 |
| RU | 2597531 | C2 | 6/2016 |
| TW | 201703660 | A | 2/2017 |
| WO | 2013043299 | A2 | 3/2013 |
| WO | 2013120566 | A2 | 8/2013 |
| WO | 2013142483 | A1 | 9/2013 |
| WO | 2013190036 | A1 | 12/2013 |
| WO | 2015082649 | A1 | 6/2015 |
| WO | 2016207192 | A1 | 12/2016 |
| WO | 2018055552 | A1 | 3/2018 |

OTHER PUBLICATIONS

Office Action issued in Japanese Appln. No. 2020-090359 dated Aug. 4, 2020. English machine translation provided.
Office Action issued in Japanese Appln. No. 2020-138169 dated Sep. 8, 2020. English machine translation provided.
International Search Report issued in Intl. Appln. No. PCT/JP2017/028149 dated Oct. 31, 2017. English translation provided.
Written Opinion issued in Intl. Appln. No. PCT/JP2017/028149 dated Oct. 31, 2017. English translation provided.
Office Action issued in Taiwanese Appln No. 107101607 dated Apr. 23, 2018. English translation provided.
Office Action issued in Korean Appln No. 10-2018-7003994 dated Oct. 3, 2018. English translation provided.
Office Action issued in Chinese Appln No. 201780002812.1 dated Jun. 25, 2019. English translation provided.
Office Action issued in Japanese Appln. No. 2020-138169 dated Oct. 27, 2020. English machine translation provided.
Notice of Allowance issued in Russian Appln. No. 2020103371 dated Oct. 26, 2020. English machine translation provided.
Office Action issued in Chinese Appln. No. 201780002812.1 dated Oct. 23, 2020. English machine translation provided.
Office Action issued in Chinese Appln. No. 201780002812.1 dated Feb. 24, 2021. English machine translation provided.
Office Action issued in Chinese Appln. No. 202010846544.5 dated Feb. 26, 2021. English machine translation provided.
Office Action issued in Japanese Appln. No. 2018-005300 dated Jun. 16, 2020. English machine translation provided.
Office Action issued in Japanese Appln. No. 2020-090359 dated Jun. 16, 2020. English machine translation provided.
Office Action issued in Chinese Appln. No. 201780002812.1 dated Jun. 24, 2020. English machine translation provided.
Office Action issued in Chinese Appln. No. 201780002812.1 dated Jun. 28, 2021. English translation provided.
Office Action issued in Japanese Appln. No. 2021-097573 dated Jun. 29, 2021. English machine translation provided.
Office Action issued in Chinese Appln. No. 202010846544.5 dated Sep. 1, 2021. English translation provided.
Notice of Dispatch of Duplicates of Written Opposition dated Jan. 12, 2022, including Written Opposition filed by a third party against Japanese Patent No. 6867064. English machine translation provided.

(56) References Cited

OTHER PUBLICATIONS

Office Action issued in Chinese Appln. No. 202010846544.5 dated Jan. 26, 2022. English translation provided.
Decision on Opposition dated Mar. 14, 2022 for Japanese Patent No. 6867064. English machine translation provided.

* cited by examiner

ELECTRONIC CIGARETTE CARTRIDGE USING TOBACCO PLANT OR NON-TOBACCO PLANT AND SUPPORT MEMBER THEREOF

BACKGROUND

Technical Field

The present invention relates to an electronic cigarette cartridge using a tobacco plant or a non-tobacco plant, and a support member thereof.

Related Art

In recent years, in order to adapt to a trend of no-smoking of tobacco, electronic cigarette products for relishing tobacco by heating a cartridge containing a tobacco ingredient without using a flame, and by inhaling the vaporized tobacco ingredient, have been started to be used widely (for example, refer to Patent Document 1 below).

In an electronic cigarette in Patent Document 1, an aerosol-forming base material is heated by inserting a heating element into the aerosol-forming base material of a cartridge and, and an aerosol containing a tobacco ingredient is generated. The cartridge has a hollow tube shaped support element supporting the aerosol-forming base material, and the support element resists a force received by the cartridge when the heating element is inserted into the aerosol-forming base material. The tobacco ingredient discharged from the aerosol-forming base material due to heat, upon passing through a hollow portion of the support element, is transferred to a mouthpiece positioned at a downstream, and is inhaled by a user.

CITATION LIST

Patent Document 1: Japanese Patent No. 6000451 Specification.

SUMMARY

Technical Problem

However, in the electronic cigarette in Patent Document 1, the support element, being hollow tube shaped, is not capable of supporting a central portion of the aerosol-forming base material when the heating element is inserted into the aerosol-forming base material, and there is a possibility of a filler sticking out to the support element.

The present invention has been made to solve issues involved in the conventional technology, and an object of the present invention is to provide a support member capable of stably supporting an aerosol-forming base material at the time of inserting a heating element, while securing a flow passage through which an aerosol is transferred inside an electronic cigarette cartridge.

Solution to Problem

The present invention for achieving the object is a support member for an electronic cigarette cartridge in which a tobacco plant or a non-tobacco plant is used. The support member has a central portion located along a central axis in a longitudinal direction of the electronic cigarette cartridge, and a side portion which extends outward from the central portion and is in contact with a packaging member located at the periphery of the electronic cigarette cartridge, and the support member is disposed adjacent to the aerosol-forming base material located at one end portion of the electronic cigarette cartridge, or is disposed with the other member sandwiched between the aerosol-forming base material and the support member, and supports the aerosol-forming base material.

Moreover, the present invention for achieving the object is an electronic cigarette cartridge using a tobacco plant or a non-tobacco plant, which has the aerosol-forming base material and the support member.

Advantageous Effects of Invention

According to the present invention, since a space is formed between the central portion of the support member and an inner surface of the packaging member covering the support member, it is possible to stably support the aerosol-forming base material by the central portion at the time of inserting the heating element into the aerosol-forming base material, while securing a flow passage through which the aerosol is transferred.

BRIEF DESCRIPTION OF THE DIAGRAMS

DETAILED DESCRIPTION OF PREFERRED EMBODIMENTS

Figure 1:
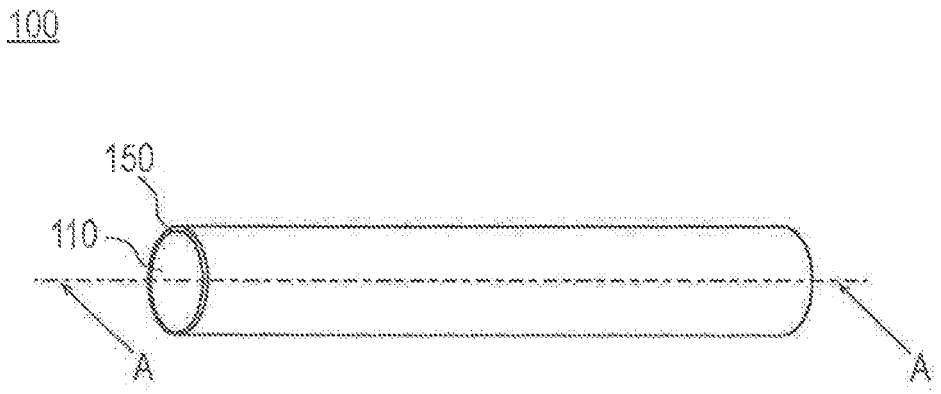
FIG. 1 is a schematic perspective view illustrating an appearance of an electronic cigarette cartridge according to an embodiment of the present invention.

An embodiment of the present invention will be described below while referring to the accompanying diagrams. Note that, in the diagrams, same reference numerals are used for same members. Moreover, a dimensional ratio is exaggerated for the sake of convenience of description, and may differ from the actual ratio.

Figure 2:
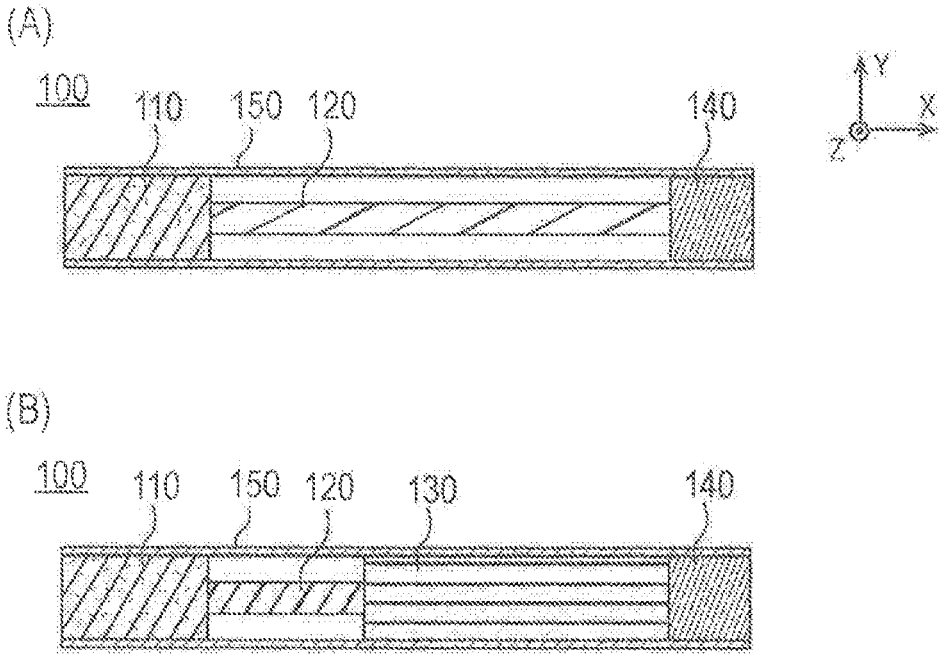
FIG. 2(A) is a cross-sectional view showing an example of an electronic cigarette cartridge cut along a line A-A in FIG. 1.
FIG. 2(B) is a cross-sectional view showing another example of the electronic cigarette cartridge cut along the line A-A in FIG. 1.
Figure 3:
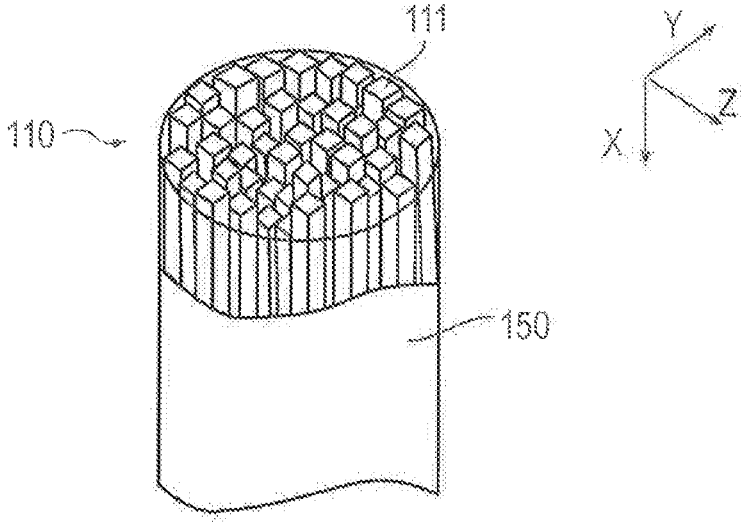
FIG. 3 is a diagram illustrating a filler of an aerosol-forming base material shown in FIG. 2(A).
Figure 4:
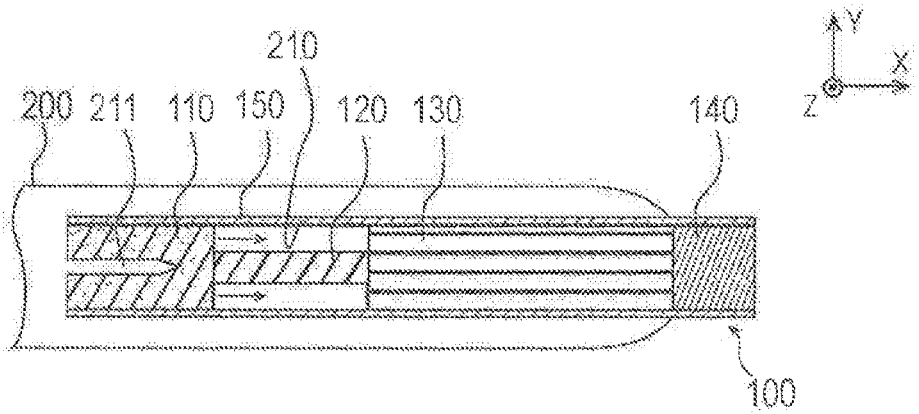
FIG. 4 is a cross-sectional view illustrating an electronic cigarette cartridge and a heating element.

FIG. 1 is a schematic perspective view showing an appearance of an electronic cigarette cartridge according to the embodiment of the present invention. Moreover, FIG. 2(A) is a cross-sectional view of an electronic cigarette cartridge cut along a line A-A in FIG. 1, and FIG. 2(B) is a cross-sectional view showing another example of the electronic cigarette cartridge cut along the line A-A in FIG. 1. Furthermore, FIG. 3 is a diagram illustrating a filler of an aerosol-forming base material shown in FIG. 2(A), and FIG. 4 is a cross-sectional view illustrating an electronic cigarette cartridge and a heating element.

Electronic Cigarette Cartridge 100

As shown in FIG. 1 and FIGS. 2(A), (2B), an electronic cigarette cartridge 100 has an aerosol-forming base material 110, a support member 120, a cooling member 130 (in a case of illustrating in FIG. 2(B)), a mouthpiece 140, and a packaging member 150. An outer shape of the electronic cigarette cartridge 100 is, for instance, a rod shape or a circular cylindrical shape.

The aerosol-forming base material 110 generates aerosol by heating. In the present embodiment, the aerosol may contain an aroma component derived from a non-tobacco plant. As shown in FIGS. 2(A), 2(B), the aerosol-forming base material 110, the support member 120, the cooling member 130 (in a case of illustrating in FIG. 2(B)), and the mouthpiece 140 are disposed in this order in an X-direction, and are encased by the packaging member 150. The packaging member 150 includes a paper for instance.

Aerosol-Forming Base Material 110

The aerosol-forming base material 110 contains at least one of a solid compound and a liquid compound. The aerosol-forming base material 110 may include an aerosol-forming base material which contains tobacco. Moreover, the aerosol-forming base material 110 may further include an aerosol former which contains glycerin or propylene glycol. In a case in which, the aerosol-forming base material 110 is solid, it may be in the form of a rod, rectangular strips, powder, granules, pellets, chips, sheet, fibers, porous material, or block. A predetermined amount or predetermined number of the aerosol-forming base material 110 in any of the abovementioned forms is put together and is filled in end portion of the electronic tobacco cartridge 100. As shown in FIG. 3, for instance, the aerosol-forming base material 110 in a state of a predetermined number of fillers 111 in the form of rods bundled together is disposed at the one end portion of the electronic tobacco cartridge 100.

A material of the filler 111 may contain at least one of tobacco leaves, tobacco stems, expanded tobacco, and homogenized tobacco. Moreover, a material of the filler 111 may include a non-tobacco plants, or in other words, a plant other than tobacco. Parts of plants that can be used include various parts such as roots (including bulbs (scaly bulbs), tuberous roots (tubers and roots), bulbs and the like), stems, barks (including stem bark, bark, and the like), leaves, flowers (including petals, pistils, stamens and the like), branches and trunks of tree.

As plants that may be used, for instance, as plants that are used as herbs and spices, it is possible to use gardenia fruit, mandarin orange leaves, Japanese ginger, mugwort, Japanese horseradish, carom seed, anise, alfalfa, echinacea, shallot, estragon, everlasting flower, elder, allspice, orris root, oregano, orange peel, orange flower, orange leaf, cayenne chili pepper, German chamomile, Roman chamomile, cardamom, curry leaf, garlic, catnip, caraway, caraway seed, osmanthus, cumin, cumin seed, clove, green cardamom, green pepper, cornflower, saffron, cedar, cinnamon, jasmine, juniper berry, jolokia, ginger, star anise, spearmint, smack, sage, sevori (savoury), celery, celery seed, turmeric, thyme, tamarind, tarragon, chervil (celfeuil), chives, dill, dill seed, tomato (dried tomato), tonka bean, dried coriander, nutmeg, hibiscus, habanero, jalapeno, birds eye, basil, vanilla, coriander, parsley, paprika, hyssop, piment d'espelette, pink pepper, fenugreek seed, fennel, brown mustard, black cardamom, black cumin, black pepper, vetiver, penny royal, peppermint (Japanese mint), horseradish, white pepper, white mustard, poppy seed, porcini, marjoram, mustard seed, melegueta, marigold, malva flower, mace, yarrow flower, eucalyptus, lavender, licorice, linden, red clover, red pepper, lemon grass, lemon scented verbena, lemon balm, lemon peel, rose, rose buds (purple), rose hip, rose petal, rosemary, rose red, laurel (laurier), long pepper, sesame (raw sesame, roasted sesame), golden pepper, Chinese prickly-ash (Hoa Jao), Mitaka spice, Japanese pepper, chili, citron and the like. Moreover, mix spices (such as five-spice powder, garam masala, ras el hanout, barigoule, chicken curry masala, tandoori masala, quatre epice, herbes du provence), and mixtures of various plants used as potpourri can be cited as examples.

Particularly, leaves of mugwort, lemon, sandalwood, peppermint, basil and the like are appropriate for use. Fruits (including seeds) of peach, blueberry, lemon, orange, apple, banana, pineapple, mango, grape, plum, almond, cacao, coffee beans, peanuts, sunflower, olive, walnut, other nuts and the like are appropriate for use.

Moreover, flowers of osmanthus, jasmine, hibiscus, rose, lavender, rosehip and the like can be used appropriately. Furthermore, roots of sandalwood, ginger, vetiver, and the like are appropriate for use. In addition, stem or bark of sugarcane, pine, Japanese cedar, yellow cedar, camellia, sandalwood, Japanese cypress, cinnamon and the like is appropriate for use.

Furthermore, teas can also be used. Teas differ not only by differing of plants that become tea but also by differing of a processing method even for the same plant. Teas, apart from black tea and green tea, include for example, ashitaba tea, hydrangea tea, gynostemma-based tea, aloe tea, ginkgo leaf tea, oolong tea, turmeric tea, quercus salicina tea, eleuthero tea, plantain tea, persimmon tea, persimmon leaf tea, German chamomile tea, chamomile tea, cassia tea, Chinese quince tea, chrysanthemum flower tea, gymnema tea, guava tea, wolfberry tea, mulberry leaf tea, black bean tea, oriental geranium tea, brown rice tea, burdock tea, comfrey tea, kelp tea, cherry tea, saffron tea, shiitake mushroom tea, perilla tea, jasmine tea, ginger tea, horsetail tea, Sekisho tea, Japanese green gentian tea, buckwheat tea, Taranoki tea, dandelion tea, Chinese blackberry leaf tea, houttuynia cordata tea, Tochu tea, sword bean tea, elderberry tea, ligustrum tea, pearl barley tea, herb tea, loquat leaf tea, pu-erh tea, safflower tea, pine needle tea, mate tea, nikko maple leaf tea, mugwort tea, eucalyptus tea, Luo Han Guo tea, rooibos tea, and the like. For these teas, tea dregs after drinking may be used. If tea dregs etc. are used, it is possible to make an efficient use by reusing an expensive tea.

Moreover, in addition to this, for example, by-products or pomace (sake cake, grape pomace (consisting of husk, seeds, stems etc. of grapes) at the time of manufacturing fermented liquors such as Japanese sake and wine, molasses of sugarcane, and the like, can also be used. Furthermore, mixtures in which, various plants mentioned above are mixed, may be used. As a matter of course, plants other than those cited here can also be used.

The aerosol-forming base material 110, for example, is manufactured by powdering the abovementioned materials, and after mixing and kneading with glycerin or oil, drying upon forming rods. Or, the aerosol-forming base material 110 is manufactured by making in the form of a paste containing water content without drying.

As shown in FIG. 3, the filler 111 manufactured as the aerosol-forming base material 110, in a case of having a shape such as a rod shape or a rectangular strip shape and the like, is filled in by letting a longitudinal direction of the shape of the filler 111 to be along an X-direction at the time of filling. Accordingly, an air flow is stabilized, and it becomes easy for a user to inhale an aroma component from the aerosol-forming base material 110.

Note that, FIG. 3 is a diagram of the electronic cigarette cartridge 100 viewed from an end of a side of the aerosol-forming base material 110, and is let to be partially transparent such that the filler 111 at an interior of the electronic tobacco cartridge 100 is visible. As a matter of course, if it is a filler in the form of a flat plate, it may be filled in by winding, and if it is a filler in the form of chips, it may be filled in randomly.

As shown in FIG. 4, the electronic cigarette cartridge 100 is mounted on an electronic cigarette main body 200 at the time of use by the user. The electronic tobacco main body 200 is provided with an inserting portion 210 for inserting the electronic cigarette cartridge 100.

Furthermore, a heating element 211 is provided at a central portion of a bottom inside the inserting portion 210, and the heating element 211 has a member in the form of a plate or in the form of a pin having a sharp front end, and is inserted into the aerosol-forming base material 110, and heats the aerosol-forming base material 110. More specifically, the heating element 211, at the time of the electronic cigarette cartridge 100 being inserted into the inserting portion 210 of the electronic cigarette main body 200, is inserted into the central portion of the aerosol-forming base material 110.

The heating element 211 generates heat directly or indirectly by an electric power supplied from a battery (not shown in the diagram) provided inside the electronic cigarette main body 200. By the aerosol-forming base material 110 being heated due to the heat of this heating element 211, an aerosol containing an aroma component is generated. Moreover, the aerosol generated is transferred to the mouthpiece 140 via the support member 120 and the cooling member 130 that will be described below (in a case of illustrating in FIG. 2(B)), and by the user inhaling from the mouthpiece 140 side, the aroma component is delivered into a mouth of the user.

Note that, in FIG. 4, although a case in which the heating element 211 has one member in the form of a pin is shown, the heating element 211 may have a plurality of members in the form of a pin.

Support Member 120

The support member 120 supports the aerosol-forming base material 110. The support member 120 is disposed adjacent to the aerosol-forming base material 110, and has a central portion 121 and a plurality of side portions 122. The central portion 121 is located along a central axis of a longitudinal direction (X-direction) of the electronic cigarette cartridge 100. The plurality of side portions 122 extends outward from the central portion 121, and makes contact with the packaging member 150 located at a periphery of the electronic cigarette cartridge 100. The side portions 122 are fixed to an inner surface of the packaging member 150 by an adhesive for instance.

Moreover, another member may be disposed between the aerosol-forming base material 110 and the support member 120. In other words, the support member 120 may be disposed sandwiching the another member between the aerosol-forming base material 110 and the support member 120. The another member may include a thin filter which eliminates fine particles of the filler 111, or another support member which supports the aerosol-forming base material 110 and the like for example.

As shown in FIG. 4, the support member 120 resists a force which the electronic cigarette cartridge 100 receives when the heating element 211 of the electronic cigarette main body 200 is inserted into the aerosol-forming base material 110, and prevents or suppresses the aerosol-forming base material 110 from moving in the X-direction.

More specifically, the side portions 122 of the support member 120 being fixed to the inner surface of the packaging member 150, the support member 120 is capable of assuredly supporting a peripheral portion of the aerosol-forming base material 110. Moreover, since the support member 120 has the central portion 121, the support member 120 is capable of preventing the filler 111 of the central portion of the aerosol-forming base material 110 from being pushed out in the X-direction by the heating element 211 which is inserted into the aerosol-forming base material 110. In such manner, in the support member 120 of the present embodiment, a flow passage for aerosol is provided not to the central portion to which the force by the heating element 211 is exerted, but to the peripheral portion.

The aerosol generated by the aerosol-forming base material 110 being heated is transferred from the one end portion to the other end portion of the electronic cigarette cartridge 100, with a space formed between the central portion 121 and the inner surface of the packaging member 150 covering the support member 120 as a flow passage (refer to arrow marks in the diagram).

Figure 5A:
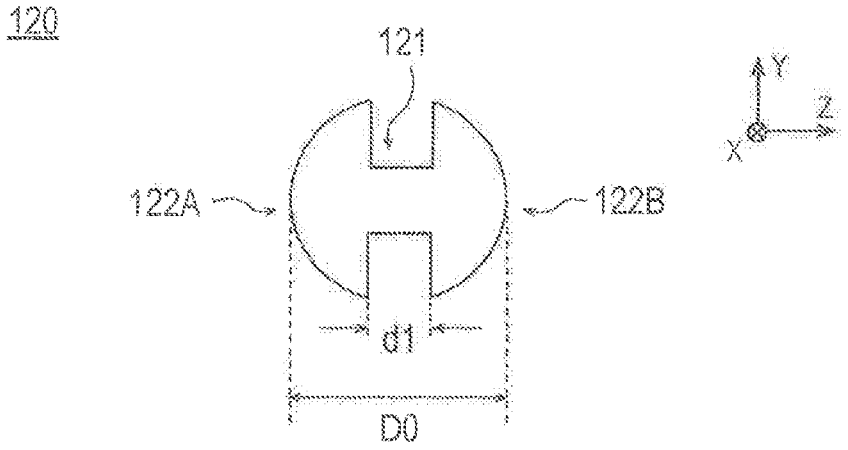
FIG. 5A is a plan view of a support member of an example 1, viewed from an X-direction in FIG. 2(A).
Figure 5B:
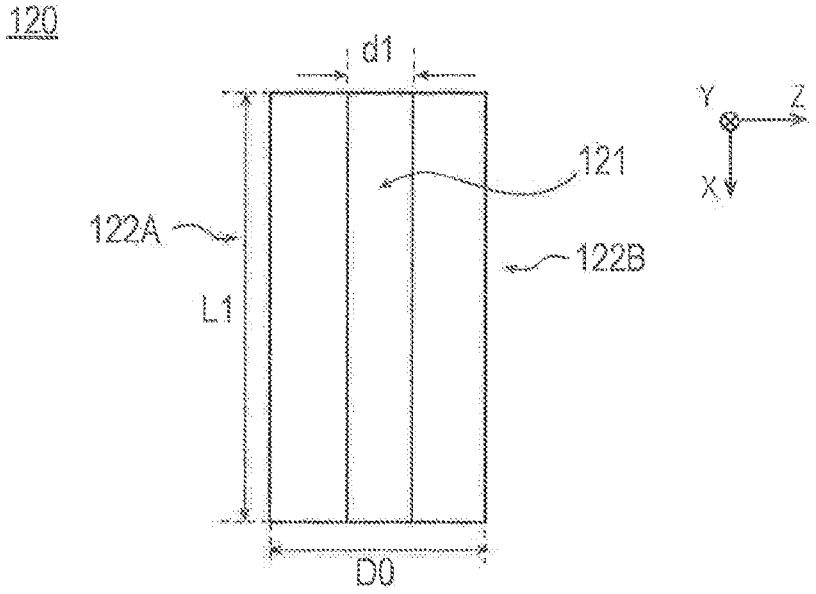
FIG. 5B is a side view of the support member of the example 1, viewed from a Y-direction in FIG. 2(B).
Figure 6A:
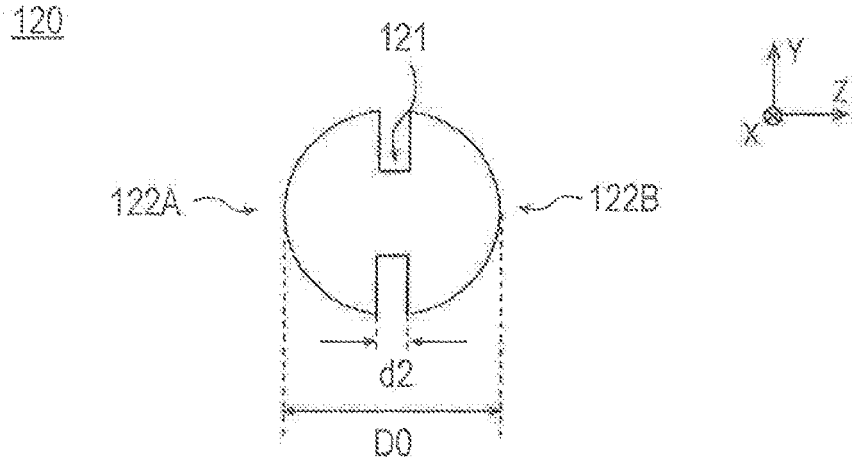
FIG. 6A is a plan view of a support member of an example 2, viewed from the X-direction in FIG. 2(A).
Figure 6B:
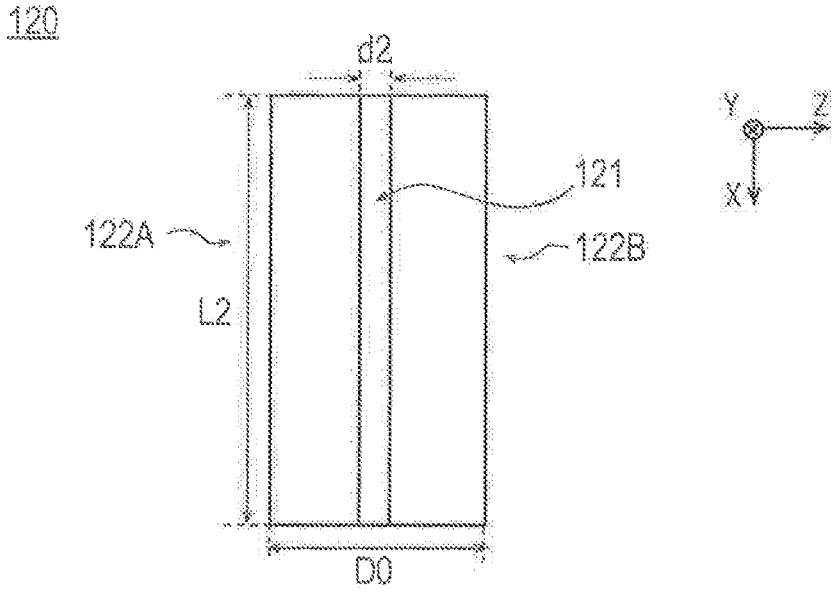
FIG. 6B is a side view of the support member of the example 2, viewed from the Y-direction in FIG. 2(A).
Figure 7A:
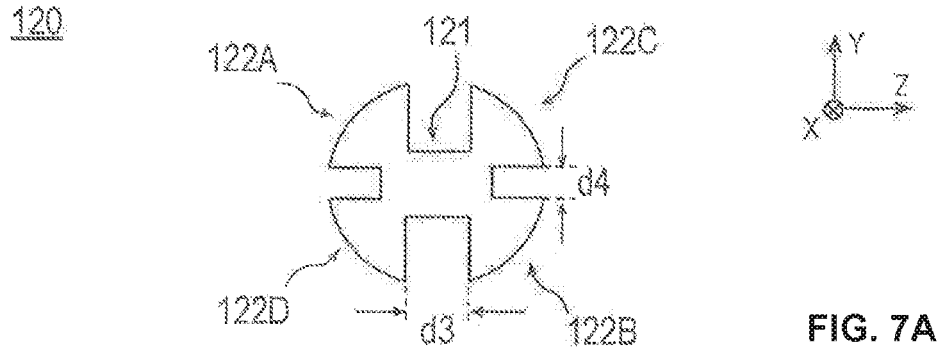
FIG. 7A is a plan view of a support member of an example 3, viewed from the X-direction in FIG. 2(A).
Figure 7B:
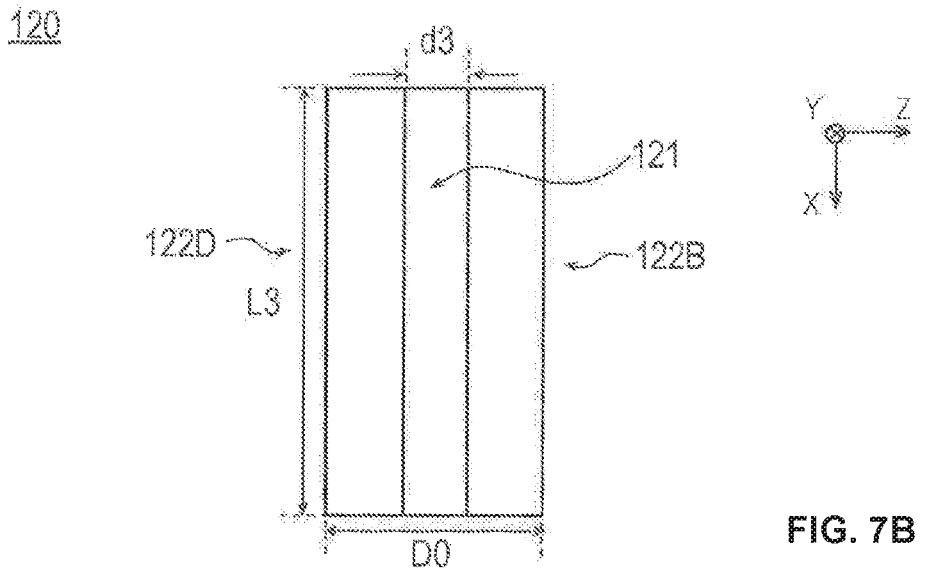
FIG. 7B is a side view of the support member of the example 3, viewed from the Y-direction in FIG. 2(A).
Figure 7C:
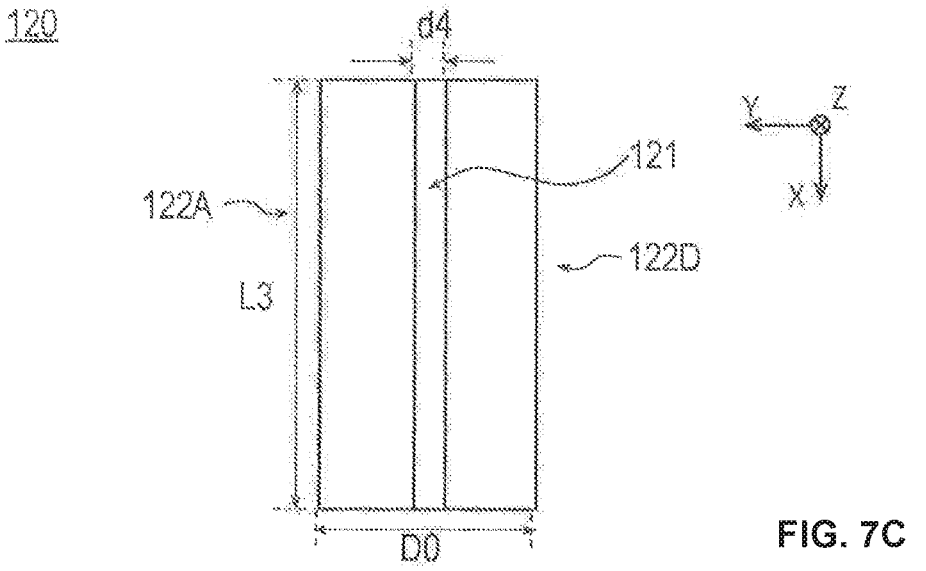
FIG. 7C is a side view of the support member of the example 3, viewed from a Z-direction in FIG. 2(A).
Figure 8A:
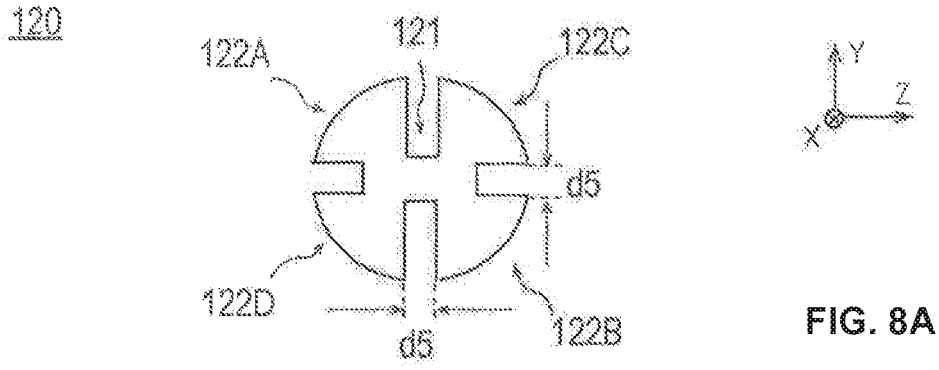
FIG. 8A is a plan view of a support member of an example 4, viewed from the X-direction in FIG. 2(A).
Figure 8B:
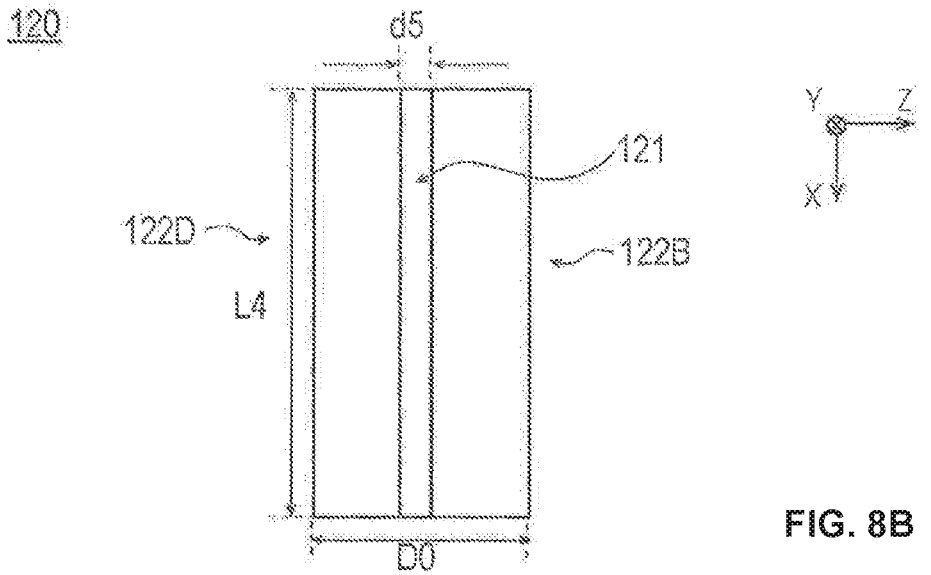
FIG. 8B is a side view of the support member of the example 4, viewed from the Y-direction in FIG. 2(A).
Figure 8C:
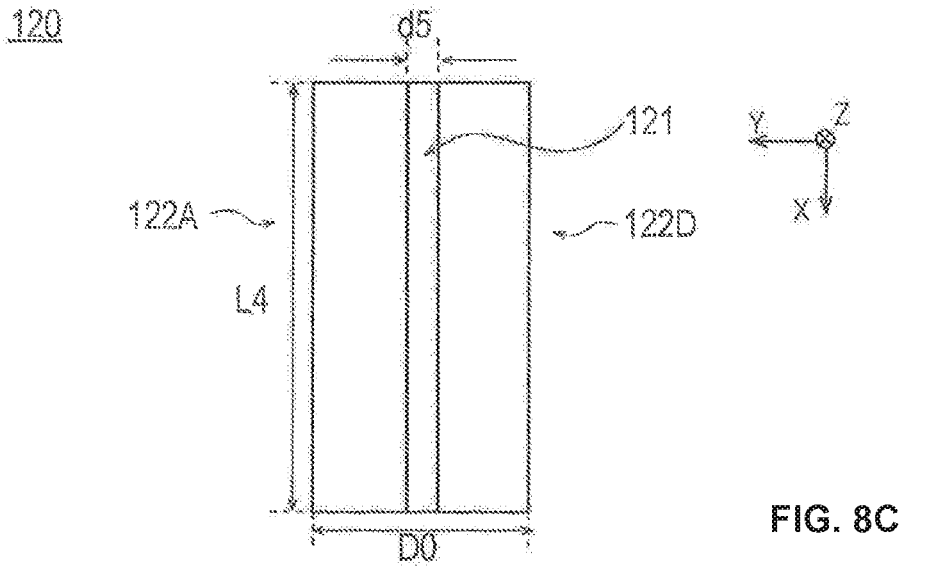
FIG. 8C is a side view of the support member of the example 4, viewed from the Z-direction in FIG. 2(A).

Examples of the support member 120 will be described below by referring to FIG. 5A to FIG. 8C. FIG. 5A is a plan view of a support member of an example 1, viewed from an X-direction in FIG. 2(A), and FIG. 5B is a side view of the support member of the example 1, viewed from a Y-direction in FIG. 2(B). Moreover, FIG. 6A is a plan view of a support member of an example 2, viewed from the X-direction in FIG. 2(A), and FIG. 6B is a side view of the support member of the example 2, viewed from the Y-direction in FIG. 2(A). Furthermore, FIG. 7A is a plan view of a support member of an example 3, viewed from the X-direction in FIG. 2(A), FIG. 7B is a side view of the support member of the example 3, viewed from the Y-direction in FIG. 2(A), and FIG. 7C is a side view of the support member of the example 3, viewed from a Z-direction in FIG. 2(A). FIG. 8A is a plan view of a support member of an example 4, viewed from the X-direction in FIG. 2(A), FIG. 8B is a side view of the support member of the example 4, viewed from the Y-direction in FIG. 2(A), and FIG. 8C is a side view of the support member of the example 4, viewed from the Z-direction in FIG. 2(A).

Example 1

As shown in FIG. 5A, the support member 120 has a first side portion 122A and a second side portion 122*b* sandwiching the central portion 121. Specifically, a cross-section of the support member 120, cut along a plane perpendicular to the X-direction assumes a shape in which a peripheral portion of a circular plate sandwiching a center of the circular plate is cut out in a rectangular shape at two locations, or in other words, a substantially H-shape of a circular periphery. A diameter of the support member 120 may be set to DO=7 mm. Moreover, it is preferable that a distance between the first side portion 122A and the second side portion 122B is set to about d1=2~3 mm for example.

Moreover, as shown in FIG. 5B, it is preferable that a length of the support member 120 in the X-direction is set to about L1=8~26.5 mm for example.

Example 2

Moreover, as shown in FIG. 6A and FIG. 6B, the diameter of the support member 120 may be set to DO=7 mm for example, and the length of the support member 120 in the X-direction may be set to about L1=8~26.5 mm for example. Furthermore, the distance between the first side portion 122A and the second side portion 122B may be set to d2=1~2 mm for example.

Example 3

As shown in FIG. 7A, the support member 120 has a first side portion 122A, a second side portion 122B, a third side portion 122C, and a fourth side portion 122D sandwiching a central portion 121. Specifically, a cross-section of the support member 120, cut along a plane perpendicular to the X-direction assumes a shape in which a peripheral portion of a circular plate sandwiching a center of the circular plate, is cut out in a rectangular shape at four locations, or in other words, a substantially X-shape of a circular periphery. A diameter of the support member 120 may be set to DO=7 mm for example. Moreover, it is preferable that a distance between the first side portion 122A and the third side portion 122C, and a distance between the second side portion 122B and the fourth side portion 122D is set to about d3=2~3 mm for example. Moreover, it is preferable that a distance between the first side portion 122A and the fourth side portion 144D, and a distance between the second side portion 122B and the third side portion 122C is set to about d4=1~2 mm.

Moreover, as shown in FIG. 7B and FIG. 7C, it is preferable that a length of the support member 120 in the X-direction is set to about L3=8~26.5 mm for example.

Example 4

Moreover, as shown in FIG. 8A to FIG. 8C, a diameter of a support member 120 may be set to DO=7 mm for example, and a length of the support member 120 in the longitudinal direction may be set to about L4=8~26.5 mm for example. Moreover, it is preferable that a distance between the first side portion 122A and a fourth side portion 122D, and a distance between the second side portion 122B and a third side portion 122C is set to about d5=1~2 mm.

In such manner, in the present embodiment, the support member 120 has the central portion 121 and the plurality of side portions 122. The central portion 121 and the plurality of side portions 122 may be formed integrally by using a die. By letting the shapes as in the abovementioned examples 1 to 4, since it is possible to easily pull apart the support member 120 from the die at the time of molding, it is possible to manufacture more easily than a hollow tube shaped support member.

Moreover, the support member 120, appropriately, may be formed by using silicone, and without being restricted to silicone, other material having a superior heat resistance may be used.

Cooling Member 130

As shown in FIG. 2(B), the cooling member 130 cools down the aerosol that has passed through the support member 120. The cooling member 130 is disposed at an opposite side of the aerosol-forming base material 110 sandwiching the support member 120, and is adjacent to the support member 120. The aroma component contained in the aerosol generated by the aerosol-forming base material 110, while being transferred along the cooling member 130, is cooled down to a temperature that can be inhaled by a person, and is transferred to the mouthpiece 140. The cooling member 130 has a sheet containing polylactic acid, and the sheet includes a plurality of gathers. Or, the sheet is contracted either by being wound in a direction orthogonal to the X-direction, or by being folded.

Note that, a length of the cooling member 130 in the X-direction may be adjusted according to the length of the support member 120 in the X-direction. As shown in FIG. 2(A), in a case in which the length of the support member 120 in the longitudinal direction is long (for instance 26.5 mm), the support member 120 is provided with a function of cooling the aroma component contained in the aerosol to a temperature of a degree that can be inhalable by a person, in addition to a function of supporting the aerosol-forming base material 110. Accordingly, it is possible to omit the cooling member 130. As a result, it is possible to reduce a manufacturing cost of the electronic cigarette cartridge 100.

Mouthpiece 140

The mouthpiece 140 is adjacent to the cooling member 130 or the support member 120, and is disposed at the other end portion of the electronic cigarette cartridge 100. The mouthpiece 140 includes a cellulose acetate filter for example, as a filter eliminating fine particles. The aroma component passed through the filter of the mouthpiece 140 is inhaled by the user. The mouthpiece 140 is fixed to the inner surface of the packaging member 150 by an adhesive for example.

The support member 120 and the electronic cigarette cartridge 100 having the support member 120 of the present embodiment described heretofore show the following effects.

A space is formed between the central portion 121 of the support member 120 and the inner surface of the packaging member 150 covering the support member 120. Accordingly, it is possible to stably support the aerosol-forming base material 110 by the central portion 121 at the time of inserting the heating element 211 into the aerosol-forming base material 110, while securing a flow passage through which the aerosol is transferred.

Moreover, since the aerosol-forming base material 110 generates the aerosol containing the aroma component of a non-tobacco plant, the user is capable of relishing flavor of a plant. Moreover, a user who has a smoking habit can use as a cigarette substitute. Furthermore, by generating an aroma of a plant that is beneficial to health of the user, health improvement of the user can be anticipated.

The present invention is not restricted to the abovementioned embodiment, and it is possible to make various modifications within the scope of the claims.

For example, in the abovementioned embodiment, a case in which, the central portion and the plurality of side portions of the support member are formed integrally, was described. However, the present invention is not restricted to the case in which the central portion and the plurality of side portions are formed integrally, and may be configured such that the central portion and the plurality of side portions are joined after being formed separately.

Moreover, in the examples 1 to 4 mentioned above, a case in which, the cross-section of the support member has a shape in which the peripheral portion of the circular plate is cut out in a rectangular shape at two locations or four locations was described. However, the cross-section of the support member, without restricting to such shape, may be a shape in which the peripheral portion of the circular plate is cut out at three locations, or five or more than five locations, or a shape in which the cut out is not in a rectangular shape but is in any form such as a triangular shape, a polygonal shape, a semicircular shape, a semielliptical shape, a curved line, or a straight line, or a combination thereof.

REFERENCE SIGNS LIST

100 electronic cigarette cartridge
110 aerosol-forming base material
120 support member
121 central portion
122, 122A, 122B, 122C, 122D side portion
130 cooling member
140 mouthpiece
150 packaging member
200 electronic cigarette main body
210 heating member

The invention claimed is:

1. An electronic cigarette cartridge comprising:

an aerosol-forming base material containing a tobacco plant or a non-tobacco plant;

a support member disposed adjacent to the aerosol-forming base material and having a central portion extending along a central axis of the electronic cigarette cartridge and a plurality of side portions extending outward from the central portion; and a packaging member in contact with the plurality of side portions, the packaging member wrapping the support member and the aerosol-forming base material.

2. The electronic cigarette cartridge according to claim 1, further configured so that an aerosol generated when the aerosol-forming base material is heated is transferred from one end portion to another end portion of the electronic cigarette cartridge through a space between the central portion and an inner surface of the packaging member.

3. The electronic cigarette cartridge according to claim 1, wherein the plurality of side portions includes a first side portion and a second side portion sandwiching the central portion.

4. The electronic cigarette cartridge according to claim 1, wherein the plurality of side portions includes a first side portion and a second side portion sandwiching the central portion.

5. The electronic cigarette cartridge according to claim 1, wherein a cross section of the support member along a plane perpendicular to a longitudinal direction of the electronic cigarette cartridge has a shape in which two portions of a peripheral portion of a circular plate are each cut out in a rectangular shape.

6. The electronic cigarette cartridge according to claim 1, wherein the plurality of side portions includes a first side portion, a second side portion, a third side portion, and a fourth side portion around the central portion.

7. The electronic cigarette cartridge according to claim 1, wherein a cross section of the support member along a plane perpendicular to a longitudinal direction of the electronic cigarette cartridge has a shape in which four portions of a peripheral portion of a circular plate are each cut out in a rectangular shape.

8. The electronic cigarette cartridge according to claim 1, wherein the support member has a length for cooling an aroma component included in the aerosol-forming base material and passing through the support member.

9. The electronic cigarette cartridge according to claim 1, further comprising:

a cooling member sandwiching the support member with the aerosol-forming base material in the packaging member and configured to cool an aerosol passing through the support member.

10. The electronic cigarette cartridge according to claim 1, wherein the aerosol-forming base material contains at least one of tobacco leaves, tobacco stems, expanded tobacco, and homogenized tobacco.

11. The electronic cigarette cartridge according to claim 1, wherein the aerosol-forming base material contains at least one of leaves, fruits, flowers, roots, stalks, stems, branches, and bark of a non-tobacco plant.

12. The electronic cigarette cartridge according to claim 1, wherein the aerosol-forming base material includes glycerin or an oil.

13. The electronic cigarette cartridge according to claim 1, wherein the aerosol-forming base material includes a plurality of members having a rod shape or a rectangular strip shape.

14. The electronic cigarette cartridge according to claim 13, wherein the aerosol-forming base material includes a plurality of members having a rod shape or a rectangular strip shape, bundled together, and being disposed such that a longitudinal direction of each of the plurality of members is along a longitudinal direction of the electronic cigarette cartridge.

* * * * *